US005132003A

United States Patent [19]

Mitani

[11] Patent Number: 5,132,003

[45] Date of Patent: Jul. 21, 1992

[54] PROCESS FOR SURFACE TREATMENT OF ALUMINUM OR ALUMINUM ALLOY

[76] Inventor: Minoru Mitani, 1228-5, Tsurugasone, Yashio-Shi, Saitama-Ken, 340, Japan

[21] Appl. No.: 601,780

[22] PCT Filed: May 9, 1990

[86] PCT No.: PCT/JP90/00591

§ 371 Date: Oct. 24, 1990

§ 102(e) Date: Oct. 24, 1990

[87] PCT Pub. No.: WO90/14449

PCT Pub. Date: Nov. 29, 1990

[30] Foreign Application Priority Data

May 16, 1989 [JP] Japan ..... 1-120469

[51] Int. Cl.[5] ..... C25D 9/02

[52] U.S. Cl. ..... 205/173; 205/170; 205/172; 205/174

[58] Field of Search ..... 205/170, 172, 173, 174

[56] References Cited

U.S. PATENT DOCUMENTS 4,310,586 1/1982 Sheasby et al. ..... 204/42

FOREIGN PATENT DOCUMENTS 61-143593 7/1986 Japan .
1-19479 5/1988 Japan .
2-97698 4/1990 Japan .

OTHER PUBLICATIONS

Chemical Abstracts, vol. 92, No. 10, Mar. 1980, Abstract No. 84887e.

*Primary Examiner*—John Niebling
*Assistant Examiner*—David G. Ryser
*Attorney, Agent, or Firm*—Hall, William D.; Joseph W. Berenato, III

[57] ABSTRACT

The present invention provides a process for surface treatment in which the surface of aluminium or its alloy can be put in a desired color and the improved wear resistance and corrosion resistance can be obtained. Anodic oxidation coatings obtained by conventional alumite treatment is porous and thus is small in wear resistance and in corrosion resistance and is insufficient in durability of coloring. The process of the present invention is characterized in that the process comprises the steps of: forming anodic oxidation coatings by conventional method on the surface of the aluminium or its alloy, thereafter applying an alternating voltage of 10 V ~ 30 V within a sulfate solution or nitrate solution of a desired metal to a member on which said anodic oxidation coatings was formed by the above step, whereby said metal is electrolytically impregnated into said anodic oxidation coatings. Thus, the metal is deposited or embedded into porous holes of the anodic oxidation coatings, the wear resistance and corrosion resistance being improved, a desired coloring being performed by the embedded metal.

4 Claims, 1 Drawing Sheet

PROCESS FOR SURFACE TREATMENT OF ALUMINUM OR ALUMINUM ALLOY

TECHNICAL FIELD

The present invention relates to an improvement of a process for the surface treatment of aluminum or aluminum alloys.

BACKGROUND ART

It is known as to anodize aluminum or its alloy within an electrolytic solution, such as an aqueous solution, of nitric acid, sulphuric acid, or chromic acid, to form a corrosion resistant oxide film. Such alumite treatment is widely utilized in various fields, for example aircraft, automobile, marine vessels, optical instruments, instruments for the chemical industry, and even daily needs such as a pan and a teakettle.

However, an upper surface of the alumite film is generally porous. Therefore, in order to improve the corrosion resistance of the porous layer, it is required to perform one of various sealing treatments, e.g. to dip the product into boiling water.

Further, an alumite film is generally of a silver white color. Therefore, when a colored product such as a building material and daily needs, is desired, it is necessary to provide a coloring treatment in which a dye or a pigment is impregnated into the porous layer of the alumite film. Further, a process for forming a natural color anodic oxidation coating by electrolysis using an electrolyte containing sulphuric acid with sulfosalicylic acid added thereto is also known. However, any of the above described processes can color only a shallow area of the upper layer of the alumite film and thus the colored area is likely to subject to wear and discoloration, so that the alumite film is not necessarily sufficient durable because a deep portion under the shallow area remains porous.

It is an object of the present invention to eliminate the above-described disadvantages of the porior art and to provide a process for the surface treatment of aluminium or aluminium alloys, which is able to color various articles and does not use a toxic material, such as cyanogen, and can produce articles having excellent corrosion and abrasion resistance.

DISCLOSURE OF INVENTION

The above object can be performed by a process the surface treatment of aluminium or aluminium alloy characterized in that the process comprises the steps of:

forming an anodic oxidation coating by conventional methods on the surface of the aluminium or aluminium alloy;

applying an alternating voltage of 10 V ~ 30 V within a sulfate solution or nitrate solution of a desired metal to a member on which said anodic oxidation castings was formed by the above step, whereby preferably, the electrolyte is comprised of metal salts of 10 ~ 25 gr/l, boric acid of 25 ~ 30 gr/l. and sulforic acid or nitric acid of 0.3 ~ 0.5 gr/l. Also, preferably, the treatment temperature is within a range of 5° C. ~ 20° C., and the alternating voltage is 10 V ~ 30 V.

Silver is most useful as the metal salt.

Further, the anodic oxidation coating may be an alumite coating formed by conventional methods or it may be an anodic oxidation coating combined with an acrylate resin compound formed by passing an eletric current through a low temperature electrolyte containing a low grade acrylate resin compound capable of being polymerized at an anode with the work piece being the anode, the latter being disclosed in Japanese Patent Applications Sho 61-251914 and Sho 63-249147, both of which were filed by the present applicant.

According to the above described process, the metal within the electrolyte may enter or penetrate into the porous oxidation coating formed on the ground metal of aluminium or its alloy to combine with the aluminium oxide to thereby form a strong and dense composite coating. Accordingly, weatherability, corrosion resistance, heat resistance and wear resistance etc. of the oxidation coating are increased, and the oxidation coating can be variously colored depending upon the kind of metal within the electrolyte and the depth of the coating into which the metal penetrates.

Thus, the process for surface treatment according to the present invention can be successfully utilized in an extremely wide range of fields in order to treat the surface of bearings, gears, a spindle, a valve, a piston, fittings, interior and exterior parts, stationery, accessories, etc., in addition to parts adapted to be contacted with magnetic tape in computers and video recorders.

BEST MODE FOR CARRYING OUT THE INVENTION

Figure 1:
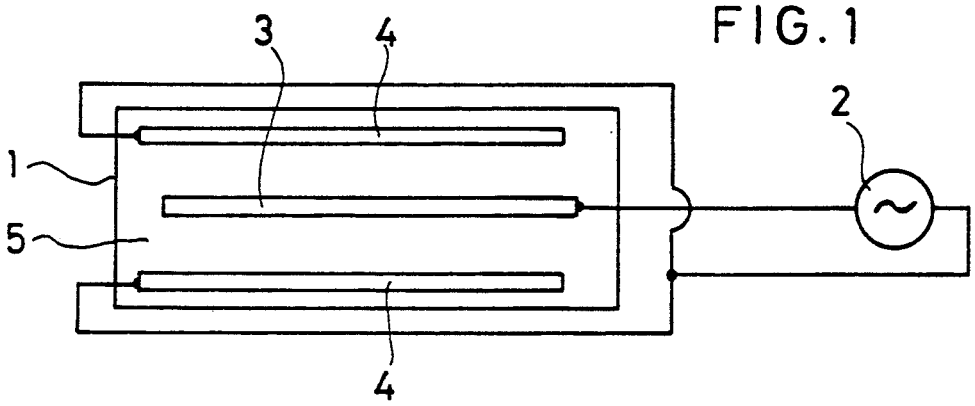
FIG. 1 is a schematic view showing an embodiment of a device for carrying out the process for surface treatment of aluminium or its alloy according to the present invention.

Referring to the drawings, in FIG. 1, reference numeral 1 depicts an electrolyte bath, is an 2 AC power source, 3 an aluminium member on which an alumite film was formed by conventional manner, 4 an electrode made from carbon or graphite, and 5 an electrolyte containing a desired metal salt.

On the surface of the aluminium member 3 to be treated is formed an alumite film of about 50 ~ 100 um thickness by conventional manner.

If it is desired that the surface of the aluminium member 3 be a golden color by as a second treatment is utilized, a silver salt is used as the metal salt of the electrolyte. In this case, the electrolyte 5, for example is composed of silver sulfate . . . 10 ~ 25 gr/l
boric acid . . . 25 ~ 30 gr/l
sulfuric acid . . . 0.3 ~ 0.5 gr/l
residue . . . water Further, it is also preferred to add the following two components to the above electrolyte:

D-tartaric acid . . . 15 ~ 25 gr/l
nickel sulfate . . . 15 ~ 25 gr/l

Voltage of AC power source 2 is 10 ~ 30 V, preferably 15 ~ 25 V. Temperature of the electrolyte is 5° ~ 20° C., preferably 10° ~ 15° C.

A decrease in the silver ion concentration as the treatment advances can be replenished by adding silver sulfate.

If the voltage is not more than 10 V, treatment efficiency is low. On the other hand, if the voltage is not less than 30 V, deposition of the metal occurs rapidly so that the metal can not sufficiently impregnate into the porous layer of alumite. In the event uneven coloring of the porous layer and separation of the metal from the porous layer is likely to occur. Similarly, if the temperature of the electrolyte is less than 5° C.~10° C., treatment efficiency is low. On the other hand, if the temperature is more than 15° C.~20° C., uneven coloring of the porous layer is likely to occur.

Boric acid is added to the electrolyte, mainly for regulating the conductivity of the electrolyte.

Figure 2:
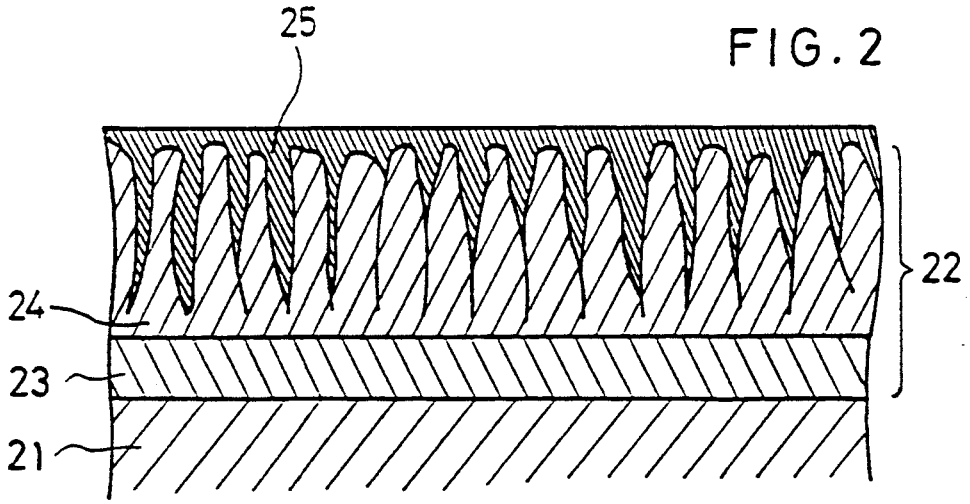
FIG. 2 is an enlarged sectional view showing a part of coating formed on aluminium or its alloy according to the process of the present invention.

Referring to FIG. 2, showing an enlarged sectional view of a skin portion having, combined anodic oxidation coatings obtained from the second treatment, will be explained hereunder.

In FIG. 2, reference numeral 21 depicts a ground metal portion of the aluminium member 3, 22 is an anodic oxidation coating formed by the alumite treatment, 23 a barrier layer of the coating 22, 24 a porous portion of the coating 22, 25 is metal impregnated into the porous portion 24 by the second treatment using an electrolyte containing the metal salts, respectively.

Anodic oxidation coatings 22, formed by the alumite treatment, consist generally of the barrier layer 23 and the porous portion 24. When the aluminium member, on which such anodic oxidation coatings are formed, is subjected to the above described second electrolytic treatment, metal molecules, such as silver etc. within the electrolyte 5, can be deeply impregnated into the porous coating 24, resulting in the strong and dense composite coatings.

As metal salts used in the electrolyte 5, metal salts others than the above described silver salt, for example copper salt, iron salt and even gold salt may be utilized. In any case, it is preferred that the electolyte contains about 15 gr/l of metal salt and other compositions as above described. If silver salt is utilized, coating of golden color is formed, and if copper salt is utilized, coating of a brown or bronze color is formed.

When silver salt is used, in particular, the obtained products have many advantages, for example, a low coefficient of friction for the surface, a beautiful golden color, and high wear resistance, and thus the silver salt is most preferably utilized.

The brown color can be varied by changing the kind of metal salt used, an its thickness, i.e. the thickness of the initial alumite layer or the time of electrolysis.

Further, as a means for forming the anodic oxidation coatings on the surface of the aluminium member prior to said second electrolytic treatment, not only the usual alumite treatment but also means for forming the anodic oxidation coating combined with an acrylate resin compound can be utilized, the latter being disclosed in Japanese Patent Applications Sho 61-251914 and Sho 63-249147, both of which were filed by the present applicant.

Since the present invention is constructed as described above, according to the present invention, the metal within the electrolyte can deeply enter into the porous oxidation coatings formed on the ground metal of the aluminium or its alloy, being combined with aluminium oxide to form strong and dense composite coatings, so that weatherability, corrosion resistance, heat resistance, and wear resistance are increased, the friction coefficient of the surface is decreased, change of color with the passage of time is reduced, machine work of the product, which was not able to be performed up to now because the coatings are separated from the ground metal, possible, and toxic chemicals, such as cyanogen, need not be used.

Further, the present invention is not limited to the above described embodiment, and thus, for example, the composition of the electrolyte or the electrolytic conditions may be suitabley changed within the object of the present invention, and therefore the present invention is intended to include all modifications which can be thought of by a person with ordinary skill in the art.

Industrial Applicability

The process for surface treatment according to the present invention can be successfully utilized in an extremely wide range of fields in order to treat the surface of bearings, gears, a spindle, a valve, a piston, fittings, interior or exterior parts, stationary, accessories etc, in addition to parts adapted to be contacted with a magnetic tape in computers and video recorders.

I claim:

1. A process for treating the surface of aluminum and aluminum alloys, comprising the steps of:

a. providing an aluminum-containing work piece having a porous anodized surface coating;

b. immersing the work piece into a first electrolyte bath comprising a polymerizable acrylate resin;

c. forming a polymerized acrylate coating on the anodized coating by passing an electric current through the first electrolyte bath;

d. thereafter immersing the work piece into a second electrolyte bath comprising a metal salt chosen from the group consisting of sulfates and nitrates, the second bath having a temperature of at least 5° C. and no more than 20° C.; and, c. impregnating the metal of the metal salt into the anodized coating by passing an alternating current of at least 10 volts and no more than 30 volts through the second bath.

2. The process of claim 1, including the step of:

a. providing a second electrolyte bath and the metal salt at a concentration of from about 10 to 25 grams per liter, and further comprising boric acid from about 25 to about 30 grams per liter, and an acid chosen from the group consisting of sulfuric and nitric at a concentration of about 0.3 to about 0.5 grams per liter.

3. The process of claim 2, including the step of:

a. providing the second electrolyte with from about 15 to about 25 grams per liter of D-tartaric acid, from about 15 to about 25 grams per liter of nickel sulfate, and the metal salt being silver sulfate.

4. The process of claim 1, including the step of:

a. selecting the metal of the metal salt from the group consisting of silver, iron and gold.

* * * * *